US005083488A

United States Patent [19]

Stanley et al.

[11] Patent Number: 5,083,488

[45] Date of Patent: Jan. 28, 1992

[54] RADIALLY ADJUSTABLE ANVIL ROLL ASSEMBLY FOR A ROTARY DIE CUTTING PRESS

[76] Inventors: Melvin Stanley, 800 Howerton La., Eureka, Mo. 63025; Thomas J. Rosemann, 993 Barbizon, Manchester, Mo. 63021

[21] Appl. No.: 685,229

[22] Filed: Apr. 12, 1991

[51] Int. Cl.[5] ..... B26D 7/26

[52] U.S. Cl. ..... 83/344; 83/346; 83/659; 83/699; 72/248; 100/168

[58] Field of Search ..... 83/344, 346, 347, 482, 83/507, 659, 663, 699; 72/248; 100/155 R, 168, 169, 172

[56] References Cited

U.S. PATENT DOCUMENTS

| | | | |
|---|---|---|---|
| 3,561,658 | 2/1971 | McDermott | 100/169 X |
| 3,683,734 | 8/1972 | Claussen | 83/663 X |
| 3,691,810 | 9/1972 | Tadeusz | 83/344 X |
| 3,720,126 | 3/1973 | Kranz | 83/344 |
| 3,803,962 | 4/1974 | Koslow | 83/110 |
| 3,855,890 | 12/1974 | Lynch et al. | 83/331 |
| 3,965,786 | 6/1976 | D'Luhy | 83/346 |
| 4,130,042 | 12/1978 | Reed | 83/881 X |
| 4,171,655 | 10/1979 | Voorhees | 83/344 |
| 4,226,150 | 10/1980 | Reed | 83/346 |
| 4,308,776 | 1/1982 | Gillespie et al. | 83/344 |
| 4,325,245 | 4/1982 | Sherwood | 72/248 |
| 4,359,919 | 11/1982 | Fuchs et al. | 83/344 X |
| 4,548,112 | 10/1985 | Thomas | 83/663 X |
| 4,922,778 | 5/1990 | Nagai | 83/501 |
| 4,926,666 | 5/1990 | Götting et al. | 72/248 X |
| 4,962,684 | 10/1990 | Mowry | 83/332 |
| 5,001,950 | 3/1991 | Fokos et al. | 83/37 |

*Primary Examiner*—Hien H. Phan
*Assistant Examiner*—Raymond D. Woods
*Attorney, Agent, or Firm*—Rogers, Howell & Haferkamp

[57] ABSTRACT

A radially adjustable anvil roll assembly is provided for use with a die cutting cylinder of a rotary die cutting press. The adjustable anvil roll assembly comprises a shaft mounted for selective and intermittent rotation on the press, and a pair of eccentrics provided on an intermediate portion of the shaft. A hollow cylindrical sleeve is mounted for free rotation on the shaft eccentrics. Rotating the shaft so that the maximum eccentricity of the eccentrics is directed toward the die cutting cylinder adjustably positions the cylindrical sleeve in its closest adjusted position toward the cylinder. Rotating the shaft 180° so that the maximum eccentricity of the eccentrics is directed away from the die cutting cylinder adjustably positions the cylindrical sleeve in a radially adjusted position furthest away from the die cutting cylinder. The shaft is selectively and incrementally rotated only when adjusting the relative position of the sleeve to the die cutting cylinder and does not rotate during cutting operations of the press.

21 Claims, 2 Drawing Sheets

RADIALLY ADJUSTABLE ANVIL ROLL ASSEMBLY FOR A ROTARY DIE CUTTING PRESS

BACKGROUND OF THE INVENTION (1) Field of the Invention

The present invention relates to an anvil roll assembly for a rotary die cutting press that is radially adjustable toward and away from the die cutting cylinder of the press.

(2) Description of the Related Art

Prior art rotary die cutting presses are often employed in cutting self-adhesive labels from layered web stock having a label material layer, an adhesive layer, and a backing material layer. The prior art die cutting cylinders employed in the presses for cutting the webs of layered material, and also employed in other similar cutting operations, are generally constructed to suit the particular type of web material employed. The thickness of the web and/or the number of web layers to be cut through must be taken into consideration when determining the clearance between the cutting edges of the die cutting cylinder and the surface of the anvil roll between which the web material is passed. This clearance is determined by the relative spacing between the cutting edges of the die cutting cylinder and the circumferential surfaces of the cutting cylinder's bearer rolls, added to the spacing between the surface of the anvil roll and the circumferential surfaces of the anvil roll's bearer rolls. If the cutting edges of the die cutting cylinder penetrate too far into the layers of the web material, the cutting edges may penetrate the backing layer of the web material causing the backing layer to tear when the cut labels are separated from the backing layer. If, on the other hand, the cutting edges of the die cutting cylinder do not penetrate far enough into the layers of the web material, the depth of the cut will be inadequate to completely penetrate through the label material and the labels will tear when they are separated from the backing material.

One approach to solving the above-described difficulties has been to provide a set of stepped anvil rolls, each cylindrical anvil roll having a different dimensioned outer diameter. The different outer diameters of the anvil rolls will position the anvil roll surfaces at different radial heights relative to the circumferential surfaces of the anvil roll end bearers depending on which anvil roll of the set is assembled on the cutting press. Interchanging the different anvil rolls on the press will adjust the anvil roll surface radially relative to the circumferential surfaces of the anvil roll end bearers, in addition to adjusting the position of the web material relative to the cutting edges of the die cutting cylinder. With a set of stepped anvil rolls, the position of the anvil roll surface relative to the circumferential surfaces of the anvil end bearers and relative to the cutting edges of the die cutting cylinder can be adjusted for web materials of different thicknesses and to compensate for wearing down of the cutting edges of the die cutting cylinder.

However, maintaining a large set of anvil rolls of different outer diameters may not be satisfactory in all situations. Maintaining a large selection of anvil rolls of different outer diameters would be a considerable expense. The manual labor required in replacing the anvil rolls on the press and the down time of the press while such replacements are made also add to the disadvantages of this approach. These shortcomings illustrate the need for an alternate solution to enable adjusting the clearance between an anvil roll surface and the cutting edges of a die cutting cylinder to accommodate the range of conditions encountered in die cutting operations.

In the Reed U.S. Pat. Nos. 4,130,042 and 4,226,150, an assembly is disclosed by which the eccentricities of end bearers of an anvil roll are varied to change the clearance between the anvil roll and cutting cylinder of a press. However, the mechanism disclosed in these patents is relatively complex, and requires that both end bearers be adjusted, thereby introducing the possibility of inaccurate adjustments due to misalignment and clearance variations across the width of the web material.

Furthermore, in related but slightly different applications of rotary presses, web materials are blanked, creased, folded, hinged and scored using rotary dies. Problems similar to those set forth above are encountered in controlling the depth of penetration of the rotary die element in creasing and scoring operations of the press, and in performing creasing and scoring operations on web materials of different thicknesses. In view of the similarities between these operations of the rotary die press and the cutting operation described above, references herein to "cutting" operations should be broadly construed and are intended to be broadly construed to include blanking, creasing, folding, hinging and scoring web materials in addition to other related operations not specifically set forth herein.

What is needed is a novel anvil roll in which the height or radial extension of the cylindrical body portion of the roll, which provides the anvil surface which opposes the cutting edges of a die cutting cylinder, can be varied in relation to the circumference of the end bearers of the anvil roll.

SUMMARY OF THE INVENTION

The radially adjustable anvil roll assembly of the present invention is generally comprised of a hollow cylindrical anvil sleeve, a shaft, a pair of eccentrics on the shaft, and a pair of bearer rolls. By "radial adjustment" what is meant is the anvil surface of the anvil roll assembly is adjustable toward and away from the die cutting cylinder of the press. The component parts of the anvil roll assembly are designed to be assembled onto a conventional rotary die cutting press of the type employing a rotary die cutting cylinder with which the anvil roll assembly of the present invention operates.

The anvil sleeve is an elongate cylinder having a hollow internal bore. The cylindrical exterior surface of the sleeve serves as the anvil surface which opposes the cutting edges of the die cutting cylinder. In cross-section, the outer and inner diameters of the sleeve are circular and are, for the most part, constant across the entire axial length of the sleeve. The side wall of the sleeve is sufficiently thick to avoid deformation of the sleeve in use, and the left and right ends of the sleeve lie in planes perpendicular to the sleeve's center axis.

The shaft is an elongate rod having an axial length larger than the axial length of the sleeve. Several journals are provided along the length of the shaft for mounting bearings on the shaft. One end of the shaft is provided with a handle for rotating the shaft manually.

The pair of eccentrics are basically a pair of circular cams. The eccentrics are positioned on an intermediate portion of the shaft and are either formed integrally with the shaft or are separate from and secured to the shaft. The circular eccentrics have center axes or center lines that are coaxial. The center lines are spaced radially a minute distance from the center axis of the shaft. In a preferred embodiment of the invention a pair of eccentrics are employed, the pair being spaced axially on the shaft. In alternate embodiments of the invention one eccentric may be employed, or three or more eccentrics may be employed. In all embodiments of the invention, the axial spacing of the eccentric, or eccentrics, on the shaft does not exceed the axial length of the sleeve.

The shaft and eccentrics extend through the interior bore of the anvil sleeve. Bearing assemblies are mounted over the peripheral surfaces of the eccentrics and engage against the interior surface of the sleeve bore. The bearing assemblies mount the anvil sleeve for free rotation on the shaft. The axis of rotation of the anvil sleeve is coaxial with the center axes of the pair of eccentrics, and is parallel to and spaced radially from the axis of rotation of the shaft.

The anvil roll assembly of the invention is mounted on a rotary die cutting press by journalling opposite ends of the shaft in bearings mounted on the press while providing access to the handle at the one end of the shaft. Prior to mounting the assembly on the press, anvil bearer rolls are mounted for free rotation on the shaft adjacent the opposite ends of the anvil sleeve. The bearer rolls engage in rolling contact with the bearer rolls of the die cutting cylinder of the rotary press. Rotation of the die cutting cylinder imparts rotation to the bearer rolls at the opposite ends of the anvil sleeve, but does not cause rotation of the shaft. The shaft rotates independently of the die cutting cylinder of the press. In operation of the press, the bearer rolls and sleeve rotate on the shaft. The shaft, apart from radial adjustments of the anvil sleeve, remains stationary relative to the press.

To radially adjust the anvil sleeve of the anvil roll assembly relative to the die cutting cylinder of the rotary die cutting press, the shaft of the anvil roll assembly is manually rotated relative to the press. In a variant embodiment of the invention, the shaft is incrementally rotated by a selectively operated motor. Manual rotation of the shaft causes the eccentrics to rotate about the axis of rotation of the shaft, with the center axes of the eccentrics rotating in a circular path around the shaft axis of rotation. The circular path traveled by the eccentric center axes will have a radius equal to the radial spacing between the shaft axis and the eccentric axes. The rotation of the eccentrics about the shaft axis causes the sleeve, rotatably supported by the eccentrics, to move radially relative to the die cutting cylinder of the press. One complete rotation of the shaft adjusts the radial position of the anvil sleeve relative to the cutting cylinder from a first position, where the sleeve is positioned closest to the cylinder, to a second position, where the sleeve is positioned furthest away from the cylinder, and then back to the first position. In the first position of the sleeve relative to the cylinder, the axes of rotation of the cylinder, sleeve, shaft, and the center axes of the eccentrics all lie in one plane. In the second position of the sleeve relative to the cylinder, the axes of rotation of the cylinder, sleeve, shaft, and the center axes of the eccentrics also lie in the same plane. In the first position of the anvil sleeve relative to the cylinder, the rotational axis of the sleeve and the center axes of the eccentrics are positioned between the rotational axes of the cylinder and the shaft. In the second position of the anvil sleeve relative to the cylinder, the axis of rotation of the sleeve and the center axes of the eccentrics are positioned on the opposite side of the shaft axis of rotation from the axis of rotation of the cylinder.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figure 1:
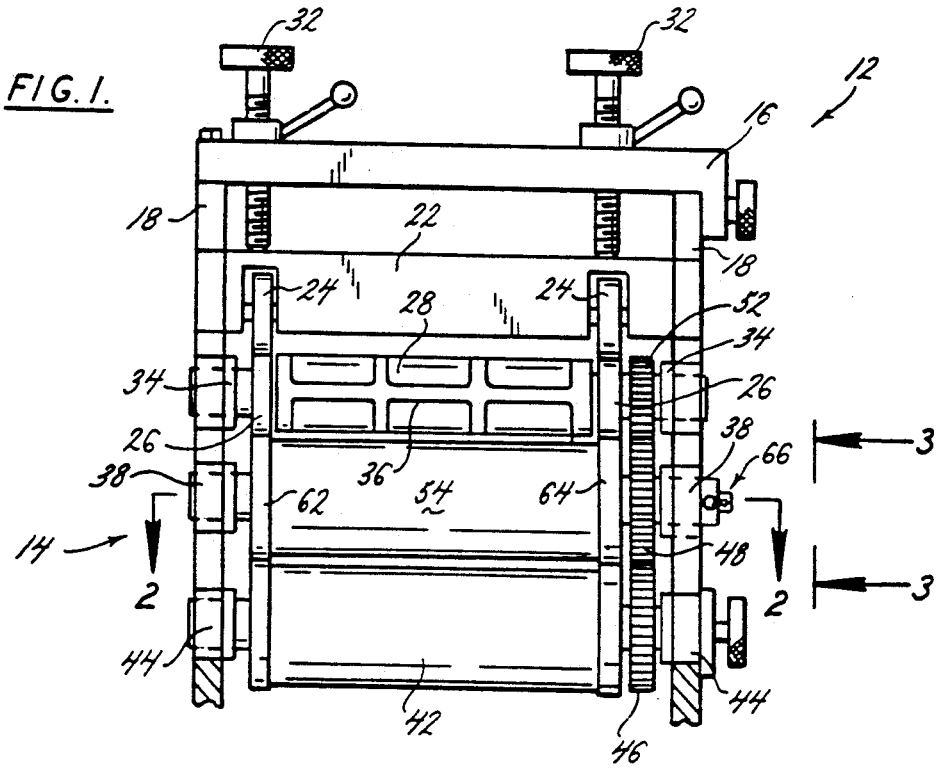
FIG. 1 is an elevation view of the operative environment of the radially adjustable anvil roll assembly of the present invention.

FIG. 1 shows a conventional die cutting press 12 employing the radially adjustable anvil roll assembly 14 of the present invention. The press 12 includes a pressure bridge 16 supported across the top of the press by a pair of opposed side frame members 18. A pressure assist bar 22 is mounted between the side frame members 18 for vertical movement relative to the press. The pressure assist 22 rotatably supports a pair of load bearer rollers 24 that bear in continuous rolling contact with a pair of load bearer rollers 26 of a die cutting cylinder 28 mounted on the press. The pressure assist 22 is urged vertically downward as seen in FIG. 1 by the pair of jack screws 32 screw threaded through the pressure bridge 16 and engaging against a top surface of the pressure assist.

The die cutting cylinder 28 is mounted for rotation to the side frame members 18 by bearings 34. The die cutting cylinder typically has a cutting die 36 formed on its exterior surface. The cutting die 36 is comprised of several cutting edges arranged in a predetermined configuration to continuously cut the desired product from a web of stock material passed through the press. The downward pressure applied on the pressure assist 22 by the jack screws 32 is transmitted to the die cutting cylinder 28 through the rolling engagement of the pressure assist load bearer rolls 24 and the die cutting cylinder load bearer rolls 26. This downward force urges the die cutting cylinder 28 downward toward the anvil roll assembly 14.

The radially adjustable anvil roll assembly 14 is mounted for rotation to the side frame members 18 of the press by bearings 38. The downward force on the die cutting cylinder presses the cutting edges of the die 36 into the web stock passed through the press to the desired extent determined by the radial adjustment of the anvil roll assembly 14. By "radial adjustment" what is meant is the anvil surface of the anvil roll assembly is adjusted toward and away from the die cutting cylinder of the press.

A drive roll 42 is mounted for rotation to the side frame members 18 by bearings 44. The drive roll 42 is powered by a suitable motor source (not shown) and rotates on the press. A drive gear 46 is secured to the drive roll 42 and rotates with the drive roll. The drive gear 46 meshes with an idler gear 48 that in turn meshes with a driven gear 52 secured to the die cutting cylinder 28. The gear chain 46, 48, 52 rotates the die cutting cylinder 28 and synchronizes the rotation of the die cutting cylinder with other operations of the press.

Figure 2:
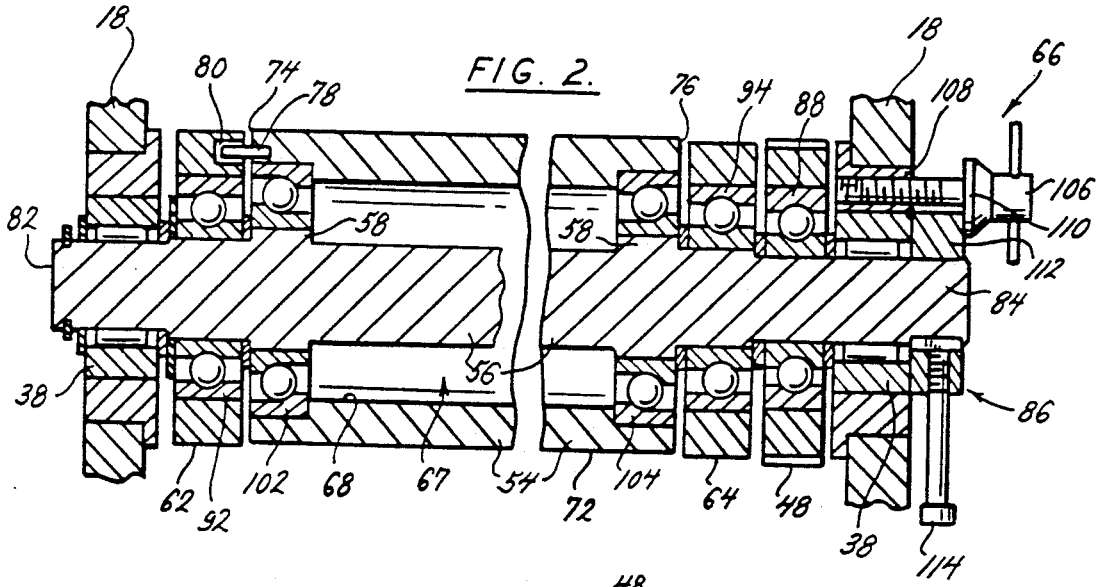
FIG. 2 is a plan view in section of the radially adjustable anvil roll assembly of the invention taken along the line 2—2 of FIG. 1.
Figure 3:
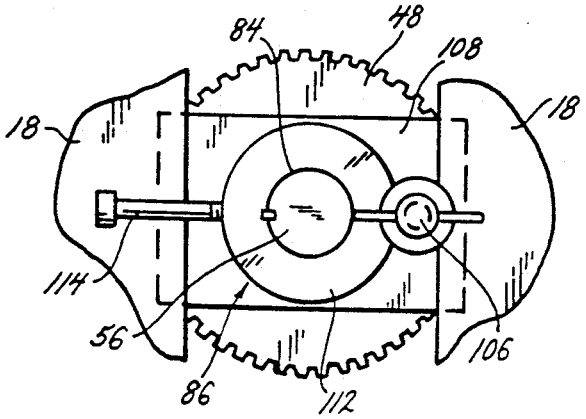
FIG. 3 is a segmented side elevation view of the anvil roll assembly of the present invention taken along the line 3—3 of FIG. 1.

The component parts of the radially adjustable anvil roll assembly 14 of the present invention are shown in cross-section in FIG. 2. The anvil roll assembly is comprised of a hollow cylindrical anvil sleeve 54, a shaft 56, a pair of eccentrics 58 on the shaft, and a pair of bearer rolls 62, 64. Also shown in FIG. 2 are the idler gear 48 referred to above, and a shaft position locking mechanism 66.

Figure 4:
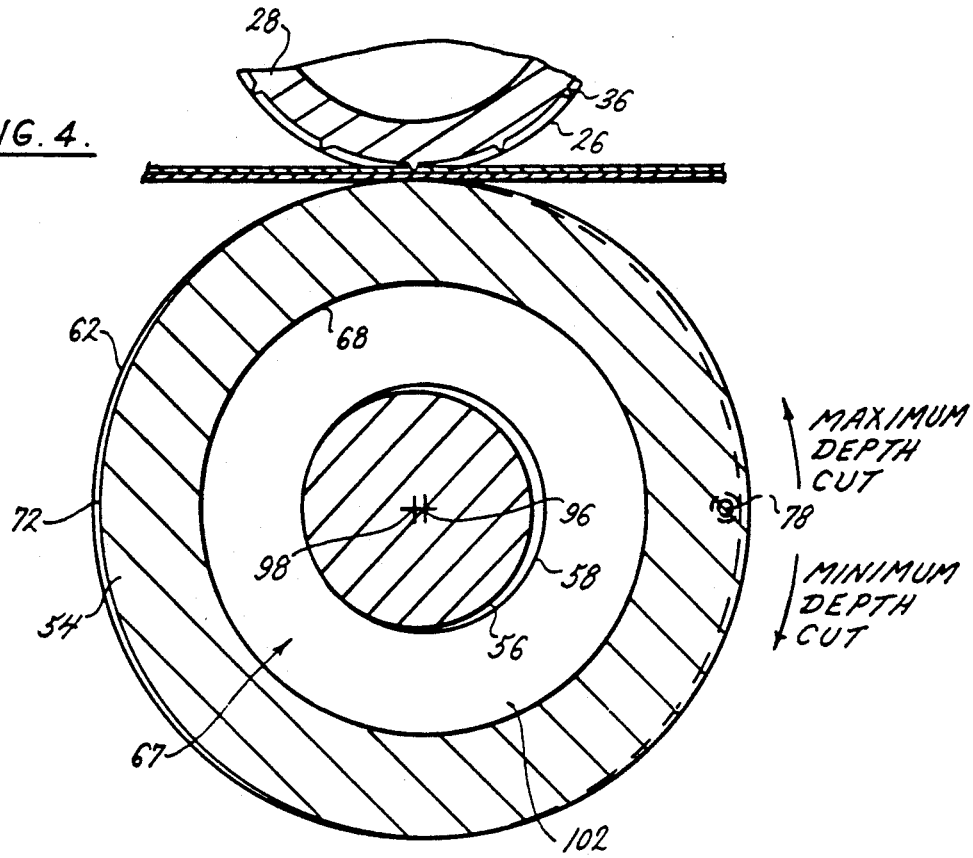
FIG. 4 is a segmented side elevation view in section of the anvil roll assembly of the present invention.
Figure 5:
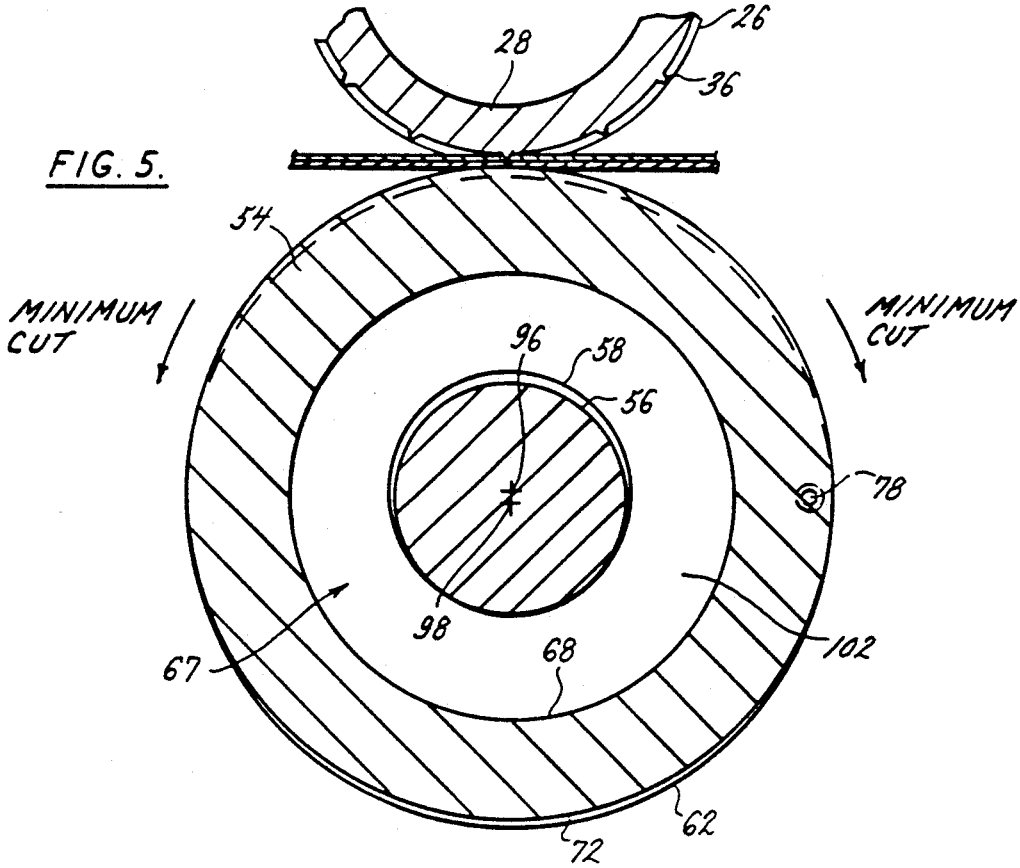
FIG. 5 is a segmented side elevation view in section of the anvil roll assembly of the present invention.

As shown in FIG. 2 and as visible in cross-section in FIGS. 4 and 5, the anvil sleeve 54 is an elongate cylindrical sleeve having a hollow internal bore 67 defined by a stepped cylindrical interior surface 68. The stepped interior surface of the sleeve 54 is employed to facilitate the positioning of bearings inside the sleeve bore 67. The stepped interior surface is not required for proper functioning of the invention and may be eliminated to reduce machining costs of the sleeve. The cylindrical exterior surface 72 of the sleeve 54 serves as the anvil surface which the cutting edges 36 of the die cutting cylinder 28 oppose. The left and right hand ends 74, 76 of the anvil sleeve, as viewed in FIG. 2, lie in planes that are perpendicular to the center axis of the sleeve. A small pin 78 projects axially from the left hand end 74 of the sleeve into a radial slot 80 in the side of the left bearer roll 62. The pin 78 is an optional feature of the invention that serves to rotate the anvil sleeve 54 on the shaft 56 in a manner to be explained. Additional pins may be employed to connect either or both of the bearer rolls in a driving connection with the sleeve, and/or to connect the sleeve or a bearer roll with the gear 48.

The shaft 56 is an elongate rod having an axial length larger than the axial length of the anvil sleeve 54 and slightly larger than the width dimension of the rotary press 12. The opposite left and right hand ends 82, 84 of the shaft 56 project slightly beyond the frame members 18 on the opposite sides of the press and are journalled in bearings 38 mounted on the frame members 18. A manual handle assembly 86 is secured to the right hand end 84 of the shaft for manually rotating the shaft on the bearings 38. The shaft 56 is also journalled in a bearing 88 supporting the idler gear 48 for rotation on the shaft, and a pair of bearings 92, 94 supporting the left and right bearer rolls 62, 64 for rotation on the shaft.

The pair of eccentrics 58 are circular cams formed integrally with the shaft 56. Although the eccentrics are disclosed in the preferred embodiment of the invention as being formed integrally with the shaft, the eccentrics could be separate from the shaft and secured to the shaft in the positions shown in FIG. 2. Furthermore, although a pair of eccentrics is employed in the preferred embodiment of the invention, a single eccentric or three or more eccentrics may be provided on the shaft without departing from the intended scope of the invention. As seen in FIG. 2, the eccentrics 58 are positioned at an intermediate portion of the shaft 56 just inside the left and right hand ends 74, 76 of the anvil sleeve 54. The circular eccentrics have center axes or center lines 96 (seen in FIGS. 4 and 5) that are coaxial. The center lines of the eccentrics are spaced radially from the center axis 98 of the shaft 56 as is best seen in FIGS. 4 and 5. As seen in FIGS. 4 and 5, the radial spacing between the center axes of the eccentrics 96 and the shaft axis of rotation 98 is minute.

Bearing assemblies 102, 104 are mounted over the circumferential surfaces of the eccentrics and engage against the interior surface 68 of the sleeve bore just inside the left and right ends 74, 76 of the sleeve. The bearing assemblies 102, 104 mount the anvil sleeve 54 for free rotation on the shaft 56. The axis of rotation of the anvil sleeve 54 is coaxial with the center axes 96 of the pair of eccentrics, and is parallel and spaced radially from the axis of rotation 98 of the shaft 56. The ball bearing assemblies shown in the drawing figures are illustrative only, and any suitable type of bearing may be employed to mount the sleeve on the eccentrics.

The locking mechanism 66 is comprised of a screw threaded key 106 that is threaded into a complimentary screw threaded hole in a bearing box 108 fixed in the right hand frame member 18 of the press. By screw threading the key 106 into the hole, a head 110 of the key engages against a collar 112 of the handle assembly 86 and secures the collar against rotation relative to the press frame 18. The collar 112 is keyed to the shaft 56 and locking the collar against movement relative to the frame effectively locks the shaft against rotation relative to the frame. Turning the locking mechanism key 106 to back the key out of the threaded hole in the bearing box 108 releases the handle assembly 86 for rotation relative to the press frame 18. By gripping a lever 114 of the handle assembly 86 and turning the level about the center axis 98 of the shaft 56, the shaft is selectively and intermittently rotated relative to the press.

In use in web cutting operations, the locking mechanism key 106 is engaged down on the handle assembly collar 112 to prevent the shaft 56 from rotating relative to the press. The drive roll gear 46 rotates the idler gear 48 freely on the shaft 56. Rotation of the idler gear drives the driven gear 52 and the die cutting cylinder 28. The bearing engagement between the end bearer rolls 26 of the die cutting cylinder 28 and the left and right bearer rolls 62, 64 of the anvil roll assembly cause the left and right bearer rolls 62, 64 to rotate freely on the shaft 56. The engagement of the axially projecting pin 78 of the anvil sleeve 54 in the radial slot 80 of the left bearer roll 62 transmits the rotation of the left bearer roll 62 to the anvil sleeve 54 and the sleeve rotates freely on the eccentrics 58. The radial extension of the slot 80 enables the pin 78 to move radially in the slot as the sleeve 54 is adjusted radially relative to the die cutting cylinder 28. As stated earlier, providing the pin 78 in the anvil roll assembly of the invention is optional. When web stock is passed between the rotating die cutting cylinder 28 and the anvil sleeve 54, the frictional engagement between the web material and the anvil sleeve and rotating die cutting cylinder will cause the anvil sleeve to rotate on the eccentrics. It should therefore be clear that the pin connection between the left end bearer roll 62 and the anvil sleeve 54 can be done away with without significantly affecting the operation of the anvil roll assembly of the invention.

To radially adjust the position of the anvil sleeve 54 relative to the die cutting cylinder 28 of the press, the shaft 56 of the anvil roll assembly is manually rotated relative to the press. In a variant embodiment of the invention, the shaft is incrementally rotated by a selectively operated motor (not shown). Manual rotation of the shaft 56 causes the eccentrics 58 to rotate about the shaft axis of rotation 98, with the center axes 96 of the eccentrics 58 rotating in a circular path around the shaft axis 98. This can best be seen in FIGS. 4 and 5 of the drawings. The circular path travelled by the eccentric center axes 96 is concentric with the shaft axis of rotation 98 and has a radius equal to the radial spacing between the shaft axis 98 and the eccentric axes 96.

The rotation of the eccentrics 58 about the shaft axis 98 causes the sleeve 54, rotatably supported on the eccentrics, to move radially relative to the die cutting cylinder of the press. Rotating the shaft 56 so that the maximum eccentricity of the eccentrics 58 is directed toward the die cutting cylinder 28 adjustably positions the cylindrical sleeve 54 in its closest adjusted position toward the cylinder. Rotating the shaft 180° so that the maximum eccentricity of the eccentrics is directed away from the die cutting cylinder adjustably positions the cylindrical sleeve in a radially adjusted position furthest away from the die cutting cylinder. The shaft is selectively and incrementally rotated only when adjusting the relative position of the sleeve to the die cutting cylinder and does not rotate during cutting operations of the press. In FIG. 5, the shaft 56 is rotated so that the eccentrics 58 are positioned at top dead center. In this position of the eccentrics the anvil sleeve 54 is moved radially upward as viewed in FIG. 5, and the exterior surface 72 of the sleeve is positioned in its closest position to the die cutting cylinder 28. One complete rotation of the shaft 56 continuously adjusts the radial position of the anvil sleeve 54 relative to the die cutting cylinder 28 between a first position shown in FIG. 5 where the sleeve is positioned closest to the cylinder, to a second position where the sleeve 54 is positioned furthest away from the cylinder 28, and then back again to the first position shown in FIG. 5. In the first position of the sleeve relative to the cylinder shown in FIG. 5, the axes of rotation of the cylinder (not shown), the shaft 98, and the coaxial axes of the sleeve and eccentrics 96 all lie in one plane. In the first position, the rotational axis of the sleeve and the center axes of the eccentrics 96 are positioned between the rotational axis of the cylinder (not shown) and the rotational axis of the shaft 98. In the second position of the sleeve 54 relative to the cylinder, the axis of rotation of the cylinder (not shown), the axis of rotation of the shaft 98, and the coaxial center axes 96 of the sleeve and eccentrics also lie in the same plane. However, in the second position of the anvil sleeve relative to the cylinder, the coaxial axis of rotation of the sleeve and the center axes of the eccentrics 96 are positioned on the opposite side of the shaft axis of rotation 98 from the axis of rotation of the cylinder (not shown).

FIG. 4 shows the positions of the eccentrics 58 in intermediate adjusted positions between the first and second positions of the shaft. In this position of the shaft, the eccentrics 58 project out to the right side of the anvil roll assembly as viewed in FIG. 4. Only small portions of the eccentrics 58 extend above the shaft 56, and these small portions of the eccentrics elevate the anvil sleeve 54 a slight distance upward toward the die cutting cylinder 28. This same vertical adjustment of the anvil sleeve 54 would be produced by rotating the shaft 56 180° from the position shown in FIG. 4 so that the eccentrics 58 project out from the left side of the shaft as viewed in FIG. 4.

Although the eccentrics of the present invention have been described as being on a shaft that rotatably mounts an anvil sleeve, it should be understood that the eccentrics may also be employed on a shaft rotatably mounting a die cutting cylinder of the press. In such an assembly, the die cutting cylinder would then be radially adjustable toward and away from the anvil roll of the press.

While the present invention has been described by reference to a specific embodiment, it should be understood that modifications and variations of the invention may be constructed without departing from the scope of the invention defined in the following claims.

We claim:

1. A radially adjustable anvil roll assembly for use with a die cutting cylinder of a rotary die cutting press, the anvil roll assembly comprising:

a cylindrical sleeve having an interior bore;

a shaft extending through the interior bore of the sleeve, the shaft being mountable on the rotary die cutting press for selective rotation relative to the press, the selective rotation of the shaft being independent of the rotation of the die cutting cylinder of the press;

bearer roll means mounted on the shaft for maintaining a fixed distance between axes of rotation of the shaft and the die cutting cylinder; and means provided on the shaft and inside the sleeve interior bore for adjusting the radial position of the sleeve relative to the die cutting cylinder and press while maintaining a fixed relative position between the shaft and the bearer roll means, in response to rotation of the shaft relative to the press.

2. The anvil roll assembly of claim 1, wherein:

there are no driving connections between the shaft and the die cutting cylinder that would communicate rotations of the cutting cylinder to the shaft.

3. The anvil roll assembly of claim 1, wherein:

the means for adjusting the radial position of the sleeve are secured to the shaft and engage against the interior bore of the sleeve.

4. The anvil roll assembly of claim 3, wherein:

the means secured to the shaft includes at least one cam assembly secured eccentrically to the shaft, the cam assembly engaging against the interior bore of the sleeve, the eccentricity of the cam assembly causing radial adjustment of the sleeve relative to the cutting cylinder and press in response to rotation of the shaft relative to the press.

5. The anvil roll assembly of claim 4, wherein:

the cam assembly includes a circular cam having a center axis parallel to and spaced from a center axis of the shaft.

6. The anvil roll assembly of claim 3, wherein:

the means secured to the shaft and engaging against the interior bore of the sleeve supports the sleeve for free rotation on the shaft.

7. The anvil roll assembly of claim 1, wherein:

at least one bearer roll is mounted on the shaft for free rotation on the shaft, the bearer roll engages the cutting cylinder and the sleeve in driving engagement, and transfers rotation of the cutting cylinder into rotation of the sleeve.

8. The anvil roll assembly of claim 7, wherein:

the sleeve is provided with a pin that extends axially from the sleeve, and the bearer roll is provided with a slot, the pin extends into the slot and engages the bearer roll in driving engagement with the sleeve.

9. The anvil roll assembly of claim 1, wherein:

the radial position of the sleeve relative to the die cutting cylinder is adjustable between a first position where the sleeve is closest to the cylinder, and a second position where the sleeve is furthest away from the cylinder, and the sleeve is radially adjusted from the first position to the second position by rotating the shaft 180° relative to the cutting press.

10. The anvil roll assembly of claim 1, wherein:

means are provided on the shaft for rotating the shaft manually relative to the cutting press.

11. A radially adjustable anvil roll assembly for use with a die cutting cylinder of a rotary die cutting press, the anvil roll assembly comprising:

a cylindrical sleeve having an interior bore and an axis of rotation that is parallel to a rotation axis of the die cutting cylinder;

a shaft extending through the interior bore of the sleeve, the shaft having an axis of rotation parallel to the axis of rotation of the sleeve, bearer roll means mounted on the shaft for maintaining a fixed distance between the axis of rotation of the shaft and the rotation axis of the die cutting cylinder, and the shaft supporting the sleeve for free rotation on the shaft with the axis of rotation of the sleeve being spaced radially from the axis of rotation of the shaft and the axis of rotation of the cutting cylinder; and means for rotating the shaft while maintaining a fixed relative position between the shaft and the bearer roll means.

12. The anvil roll assembly of claim 11, wherein:

the shaft is mounted on the cutting press for rotation relative to the press, the rotation of the shaft adjusts the radial spacing of the axis of rotation of the sleeve relative to the axis of rotation of the cutting cylinder.

13. The anvil roll assembly of claim 11, wherein:

the shaft has at least one circular cam assembly provided thereon, the circular cam assembly has a center axis that is parallel to the axes of rotation of the shaft, sleeve, and cutting cylinder, and is coaxial with the axis of rotation of the sleeve.

14. The anvil roll assembly of claim 13, wherein:

the circular cam assembly engages against the interior bore of the sleeve and supports the sleeve for free rotation on the shaft.

15. The anvil roll assembly of claim 13, wherein:

the circular cam assembly supports the sleeve for free rotation on the shaft and adjusts the radial spacing of the axis of rotation of the sleeve from the axis of rotation of the cutting cylinder in response to rotation of the shaft relative to the die cutting press.

16. The anvil roll assembly of claim 12, wherein:

the radial spacing between the axis of rotation of the sleeve and the axis of rotation of the cutting cylinder is adjustable between a first spacing where the axis of rotation of the sleeve is closest to the axis of rotation of the cylinder, and a second spacing where the axis of rotation of the sleeve is furthest away from the axis of rotation of the cylinder, and the radial spacing is adjusted from the first spacing to the second spacing by rotating the shaft a half revolution relative to the cutting press.

17. The anvil roll assembly of claim 16, wherein:

the axes of rotation of the cutting cylinder, sleeve, and shaft are coplanar in both the first spacing and the second spacing between the axis of rotation of the sleeve and the axis of rotation of the cutting cylinder.

18. The anvil roll assembly of claim 12, wherein:

the shaft is mounted on the cutting press for manual rotation independent of rotation of the cutting cylinder and rotation of the sleeve.

19. A radially adjustable anvil roll assembly for use with a die cutting cylinder of a rotary die cutting press, the anvil roll assembly comprising:

a cylindrical sleeve having an interior bore and an axis of rotation parallel to and spaced radially from an axis of rotation of the die cutting cylinder;

a shaft extending through the interior bore of the sleeve, the shaft having an axis of rotation parallel to the axes of rotation of the cutting cylinder and the sleeve, and the shaft supporting the sleeve for free rotation on the shaft with the axis of rotation of the sleeve being radially spaced from the axis of rotation of the shaft, bearer roll means mounted on the shaft for maintaining a fixed distance between the axis of rotation of the shaft and the axis of rotation of the die cutting cylinder and the shaft supporting the sleeve for radial adjustment of the axis of rotation of the sleeve relative to the axis of rotation of the cutting cylinder while maintaining a fixed relative position between the shaft and the bearer roll means in response to rotation of the shaft relative to the die cutting press.

20. The anvil roll assembly of claim 19, wherein:

at least one circular cam assembly is provided on the shaft, the circular cam assembly has a center axis that is coaxial with the axis of rotation of the sleeve, and the cam assembly has a circumferential surface that bears against the interior bore of the sleeve and supports the sleeve for free rotation on the shaft.

21. A radially adjustable anvil roll assembly for use with a die cutting cylinder of a rotary die cutting press, the anvil roll assembly comprising:

a cylindrical sleeve having an exterior surface, an interior bore and a longitudinal center axis parallel to a center axis of the die cutting cylinder of the press;

a shaft extending through the interior bore of the sleeve and supporting the sleeve for rotation on the shaft in a radially spaced position relative to the die cutting cylinder of the press, bearer roll means mounted on the shaft for maintaining a fixed distance between axes of rotation of the shaft and the die cutting cylinder, the shaft having a center axis parallel to the center axis of the die cutting cylinder of the press and the shaft being mounted for rotation on the press; and means provided on the press and engaging the sleeve for adjusting a radial spacing of the sleeve center axis from the die cutting cylinder center axis while maintaining a fixed relative position between the shaft and the bearer roll means, by selectively moving the sleeve toward and away from the die cutting cylinder.

* * * * *